US011635048B2

(12) United States Patent
Uchida

(10) Patent No.: US 11,635,048 B2
(45) Date of Patent: Apr. 25, 2023

(54) ENERGY CONVERSION EFFICIENCY IMPROVEMENT DEVICE

(71) Applicant: TokyoMirai Co., Ltd., Inagi (JP)

(72) Inventor: Keisuke Uchida, Tokyo (JP)

(73) Assignee: TOKYOMIRAI CO., LTD., Tokyo (JP)

( * ) Notice: Subject to any disclaimer, the term of this patent is extended or adjusted under 35 U.S.C. 154(b) by 0 days.

(21) Appl. No.: 17/765,732

(22) PCT Filed: Sep. 30, 2020

(86) PCT No.: PCT/JP2020/037072
§ 371 (c)(1),
(2) Date: Mar. 31, 2022

(87) PCT Pub. No.: WO2021/065979
PCT Pub. Date: Apr. 8, 2021

(65) Prior Publication Data

US 2022/0364533 A1 Nov. 17, 2022

(30) Foreign Application Priority Data

Oct. 2, 2019 (JP) ..... JP2019-181886

(51) Int. Cl.
*F02M 27/04* (2006.01)

(52) U.S. Cl.
CPC ..... *F02M 27/04* (2013.01)

(58) Field of Classification Search
CPC ..... F02M 27/04
See application file for complete search history.

(56) References Cited

U.S. PATENT DOCUMENTS

2005/0016508 A1* 1/2005 Monette ..... F02M 27/04 123/538
2015/0004550 A1 1/2015 Tzavaras

FOREIGN PATENT DOCUMENTS

CN 103779031 A * 5/2014 ..... F02M 27/04
CN 102216574 B * 9/2015 ..... F01M 13/00
CN 107191296 A * 9/2017
JP H06-83948 U 12/1994

(Continued)

OTHER PUBLICATIONS

International Search Report dated Nov. 24, 2020, issued in counterpart Application No. PCT/JP2020/037072. (2 pages).

*Primary Examiner* — Hung Q Nguyen
(74) *Attorney, Agent, or Firm* — WHDA, LLP

(57) ABSTRACT

The present invention enables the energy conversion efficiency of installed equipment and the like to be further improved. An energy conversion efficiency improvement device 1 includes: a first antenna 10 which is formed by winding a conducting wire, the two ends of the conducing wire being connected to a direct-current power source; an LC circuit unit 11 which is connected to the conducting wire constituting the first antenna 10, and which includes at least one LC module obtained by connecting an inductance element and a capacitor element in series or in parallel; a joined material portion 12 obtained by joining at least two different types of materials together; and a horn component 13 which comprises a conductor, is formed with line symmetry across a central axis, and is formed with a shape having an external diameter that increases in one direction along the central axis.

19 Claims, 14 Drawing Sheets

(56) References Cited

FOREIGN PATENT DOCUMENTS

| | | | | | |
|---|---|---|---|---|---|
| JP | 2014-505819 | A | | 3/2014 | |
| JP | 6253115 | B2 | | 12/2017 | |
| JP | 2018-059466 | A | | 4/2018 | |
| KR | 100881950 | B1 | * | 2/2009 | |
| WO | WO-0015957 | A1 | * | 3/2000 | ..... F02M 27/04 |
| WO | WO-2008068409 | A2 | * | 6/2008 | ..... F02M 27/04 |

* cited by examiner

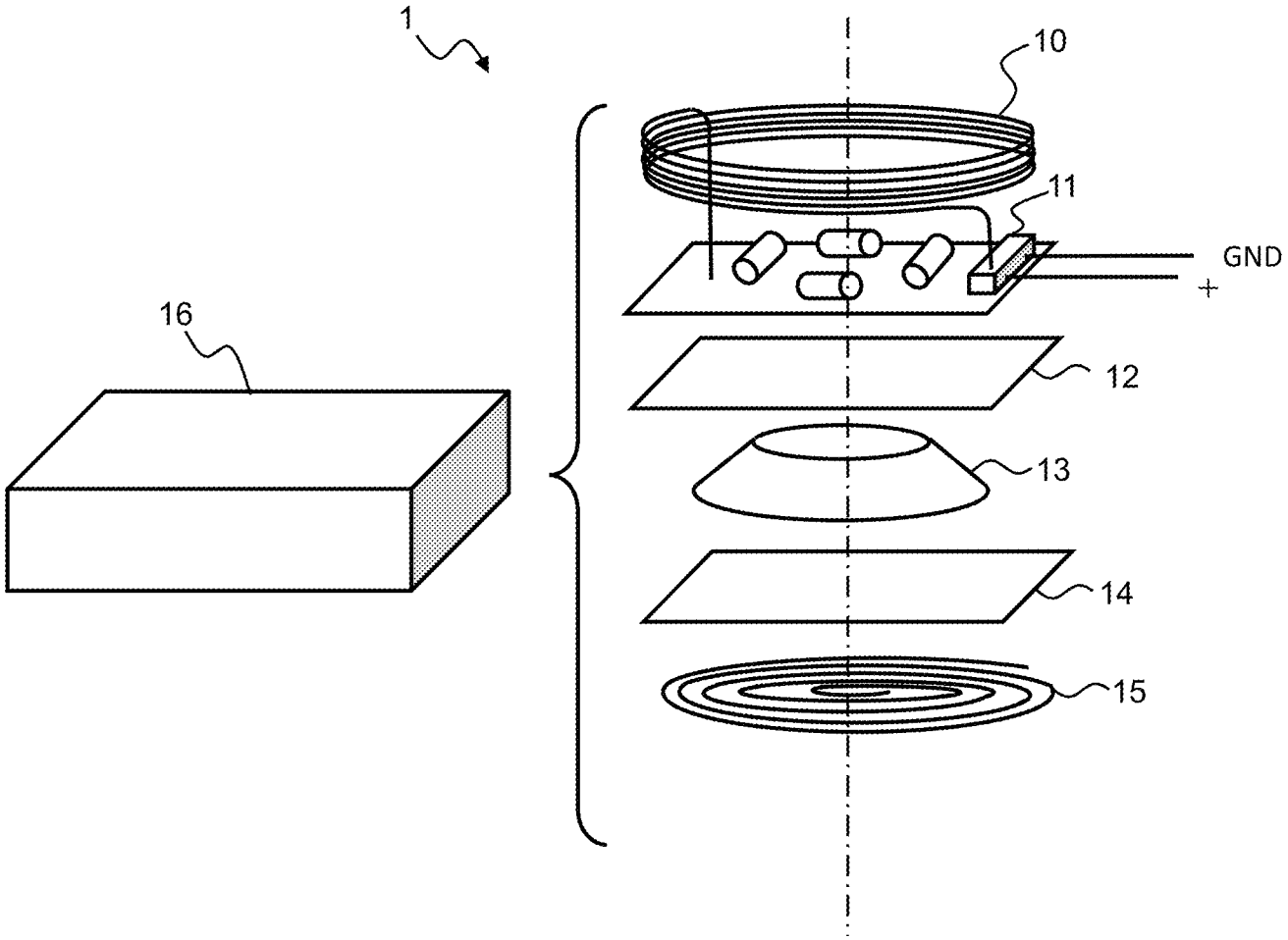
[Fig. 1]

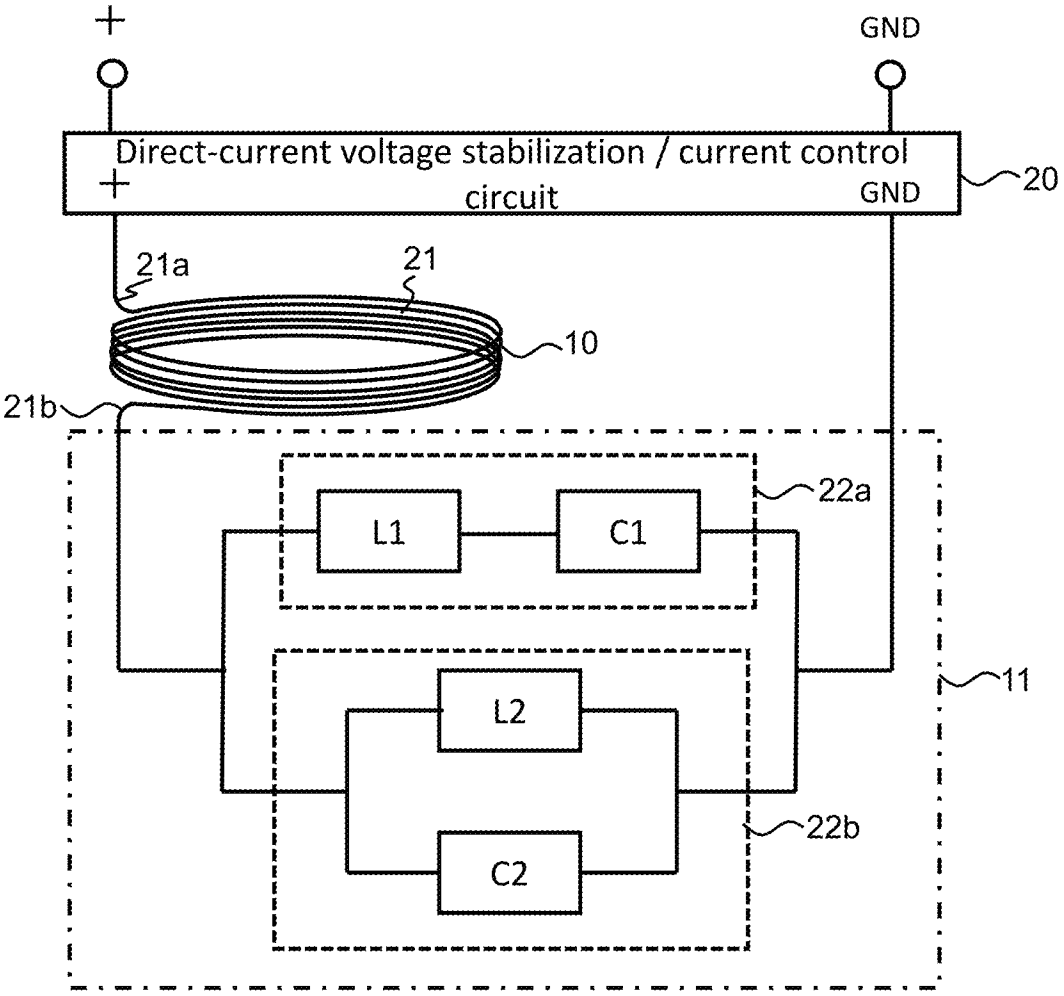
[Fig. 2]

[Fig. 4]
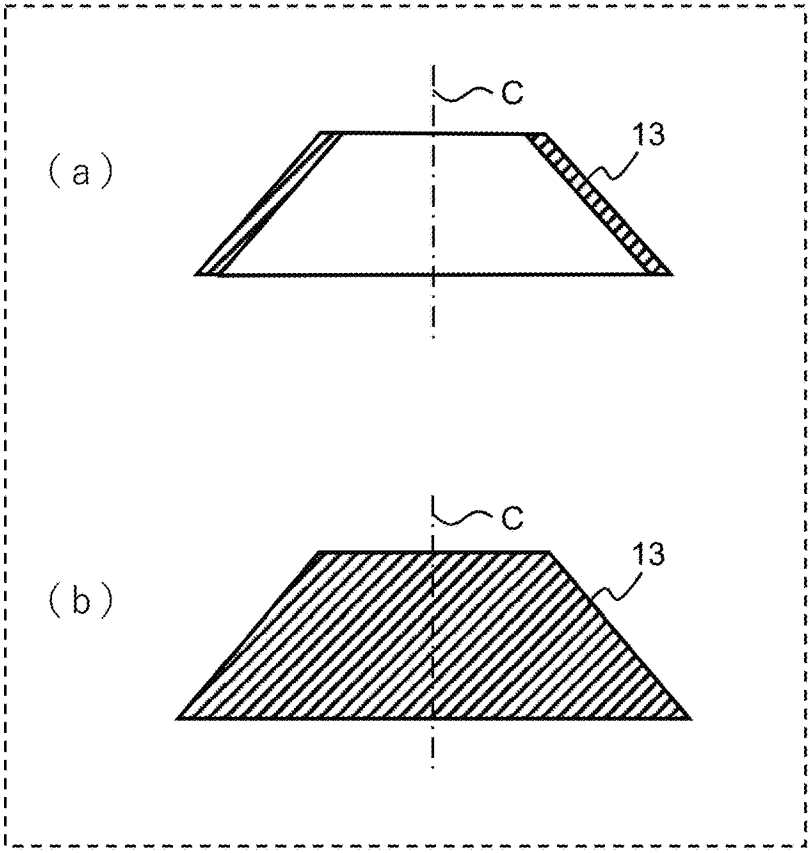
[Fig. 3]
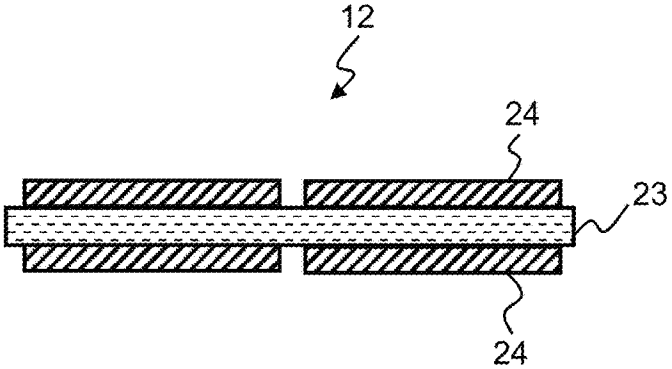

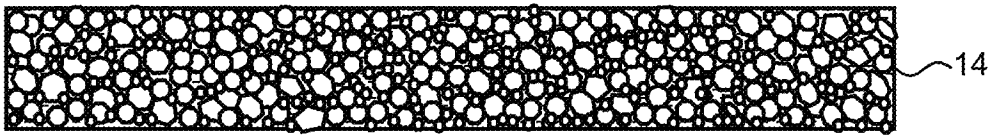
[Fig. 5]
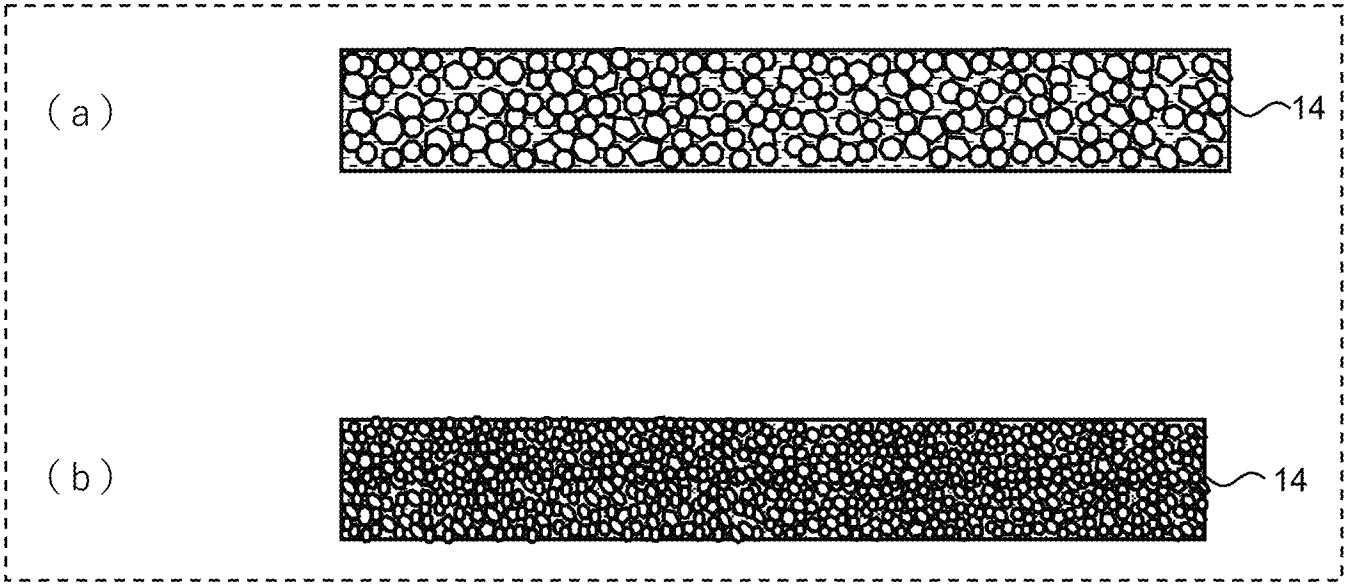
[Fig. 6]

[Fig. 7]
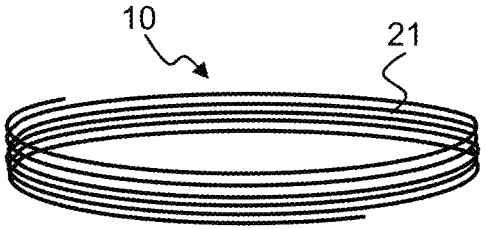
[Fig. 8]
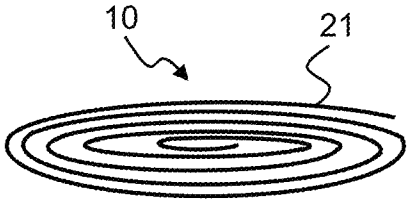
[Fig. 9]
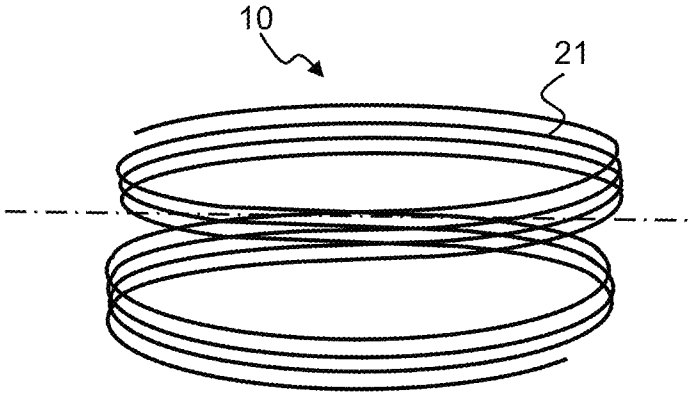
[Fig. 10]
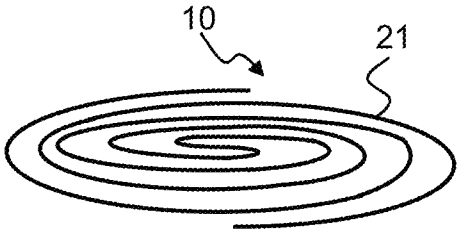

[Fig. 12]
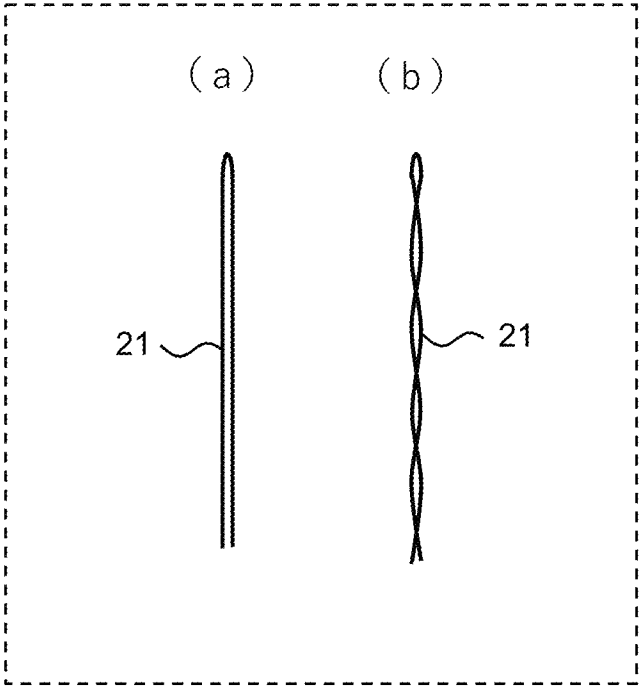
[Fig. 11]
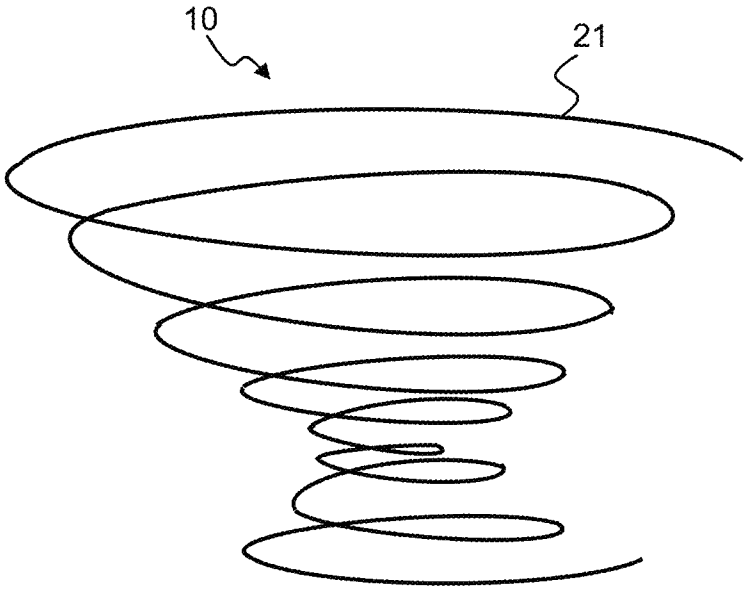

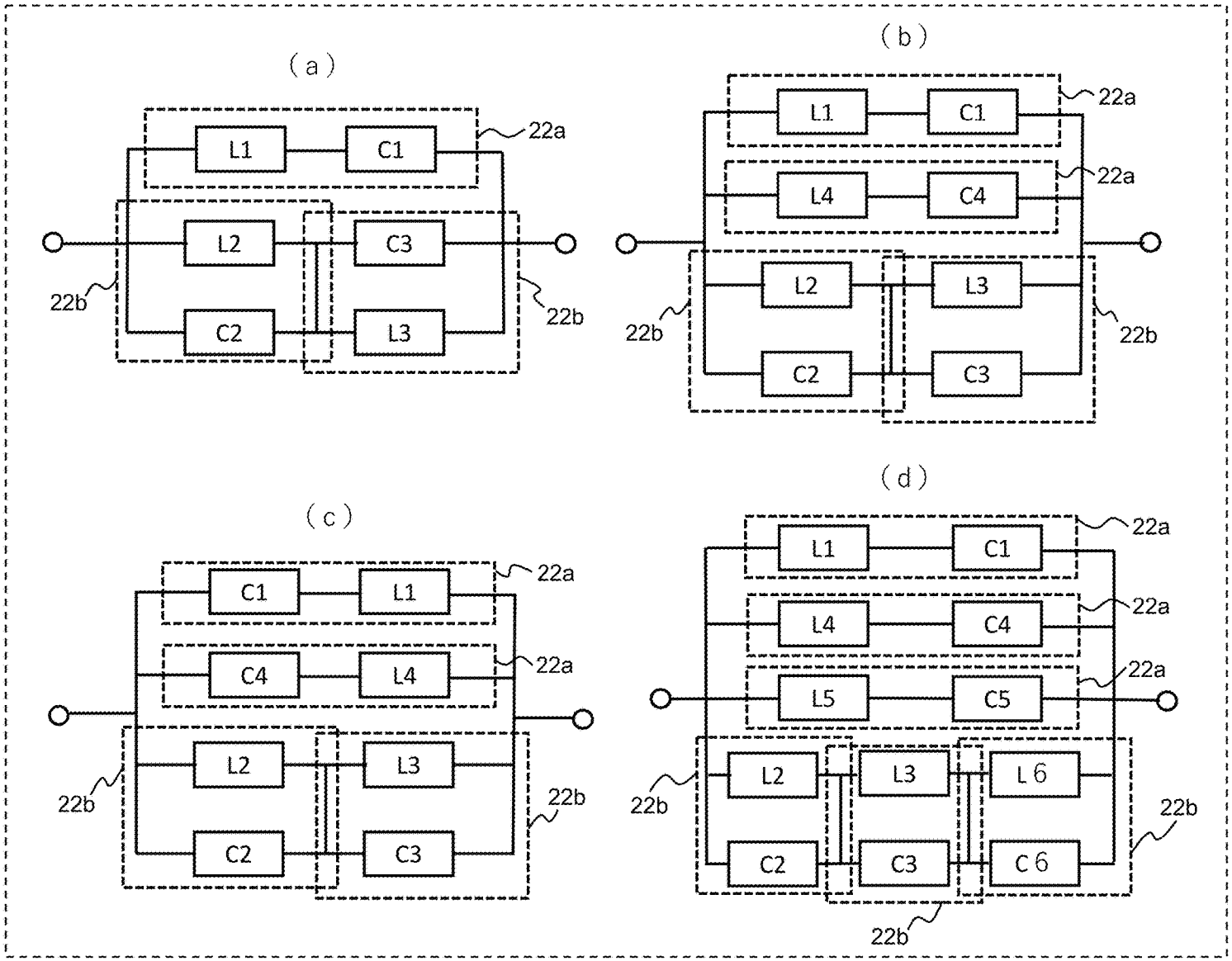
[Fig. 13]

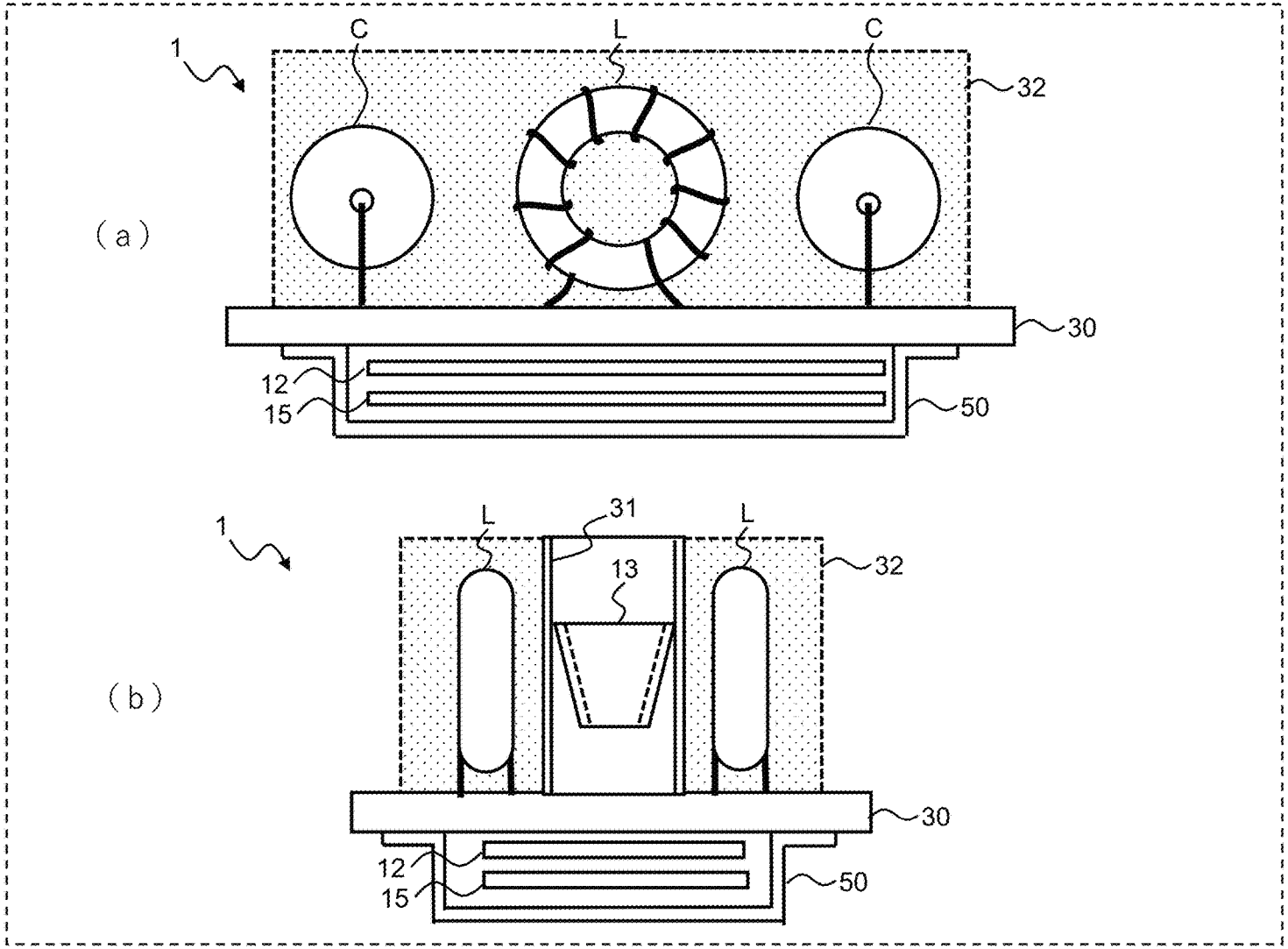
[Fig. 14]

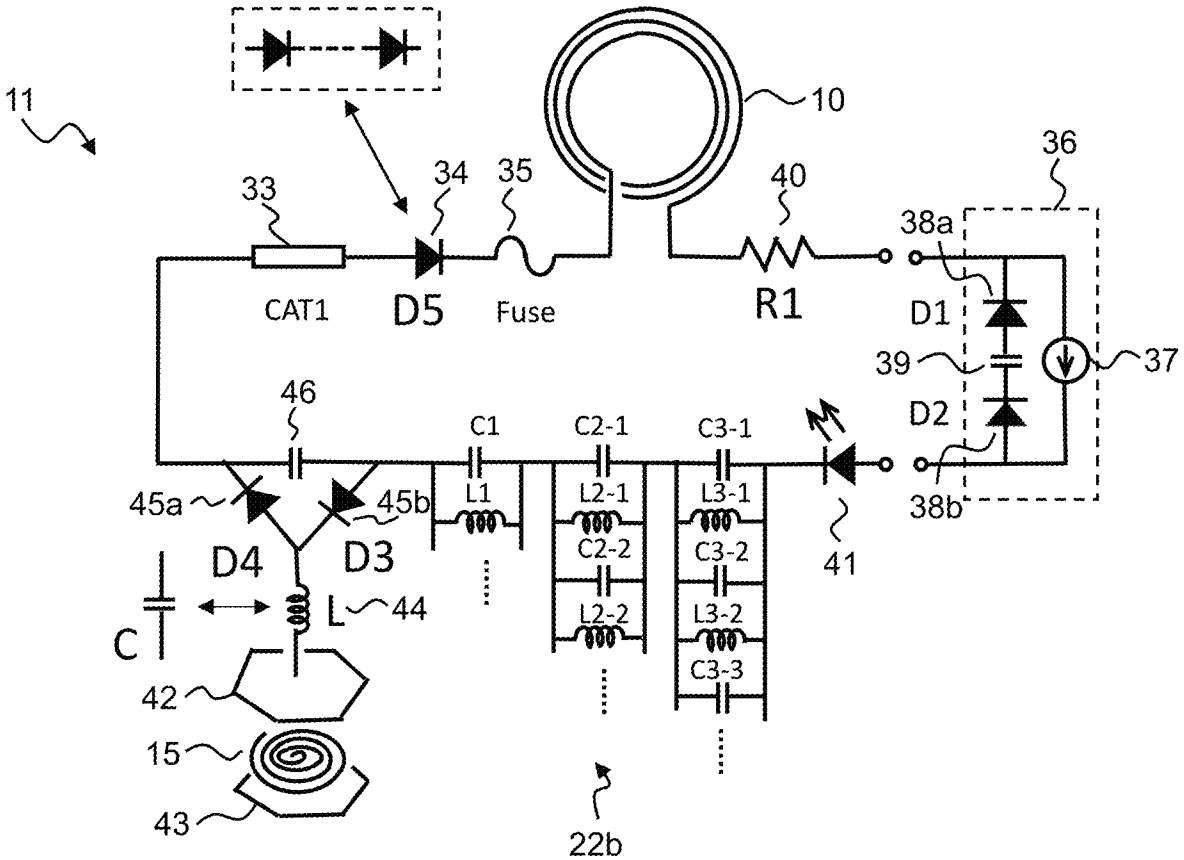
[Fig. 15]

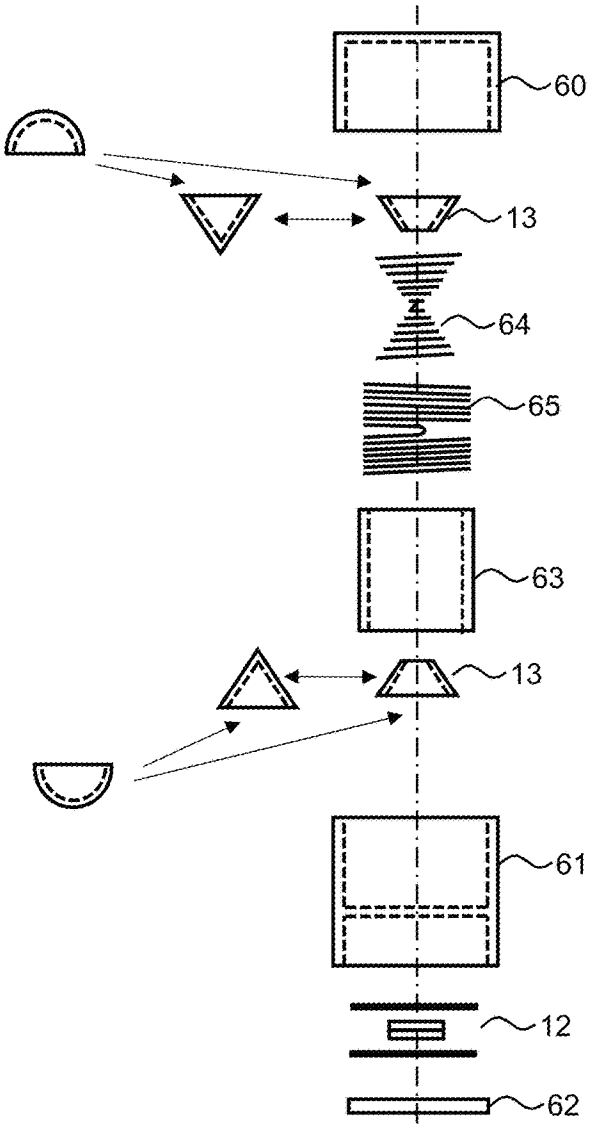
[Fig. 16]

[Fig. 17]
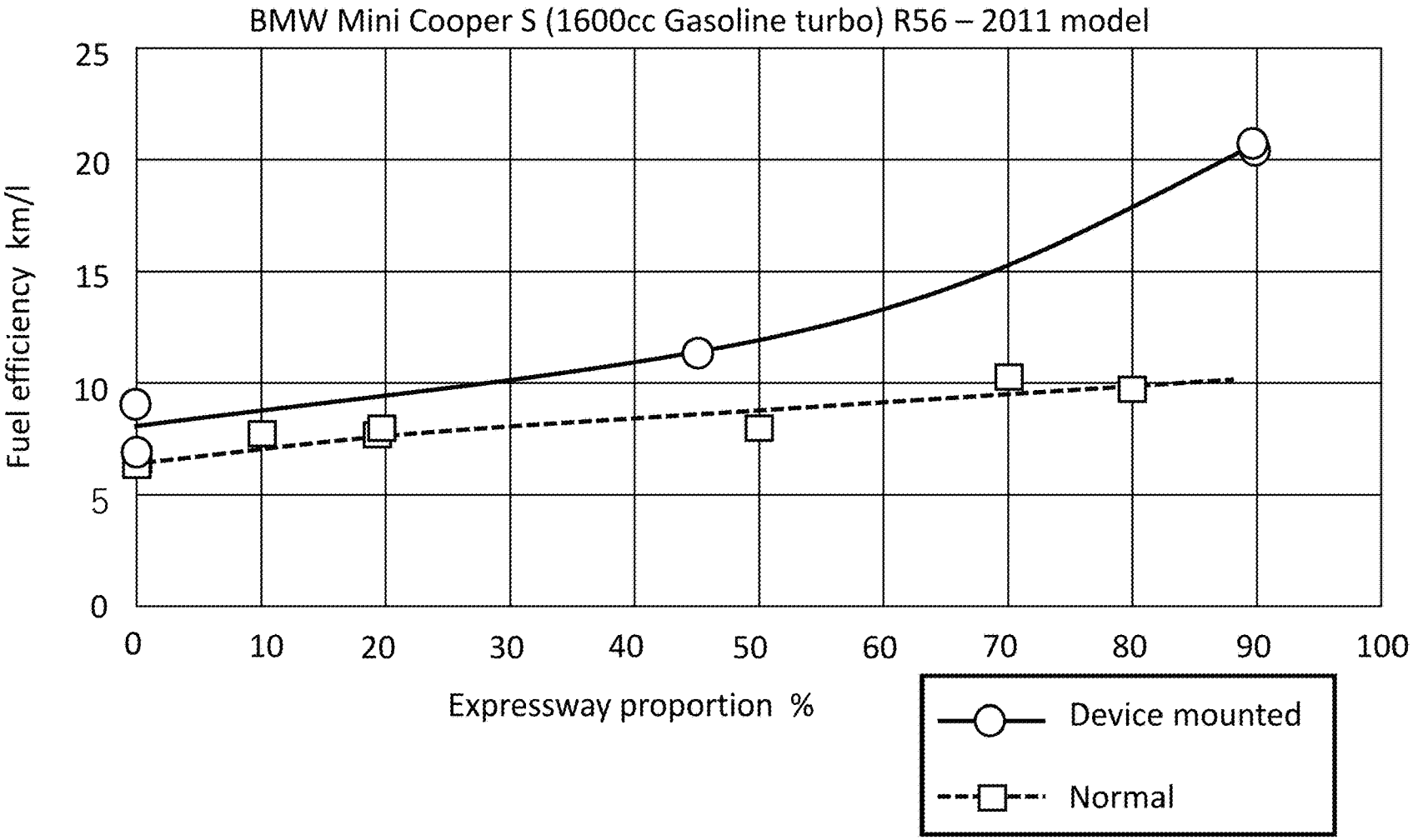

[Fig. 18]
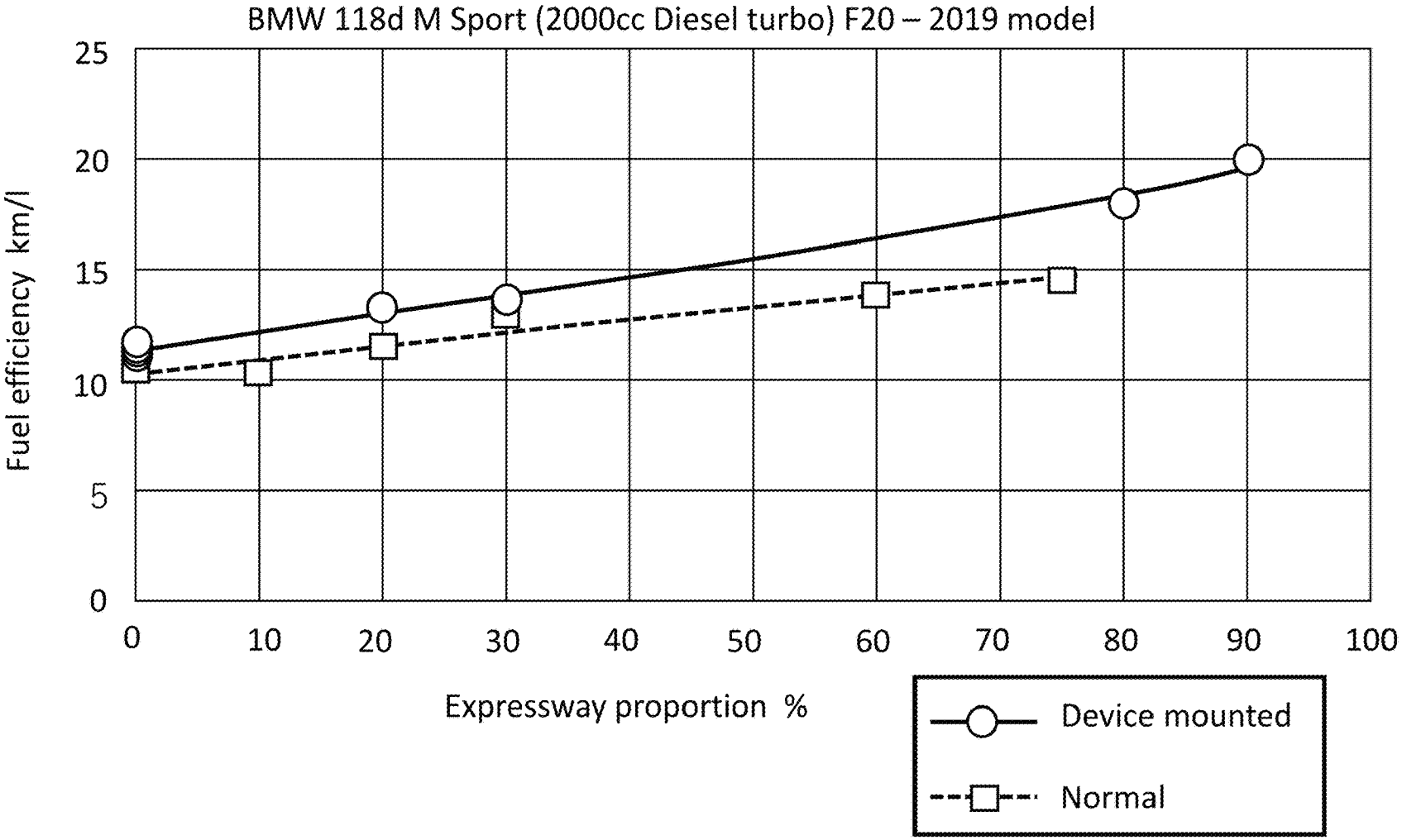

[Fig. 19]
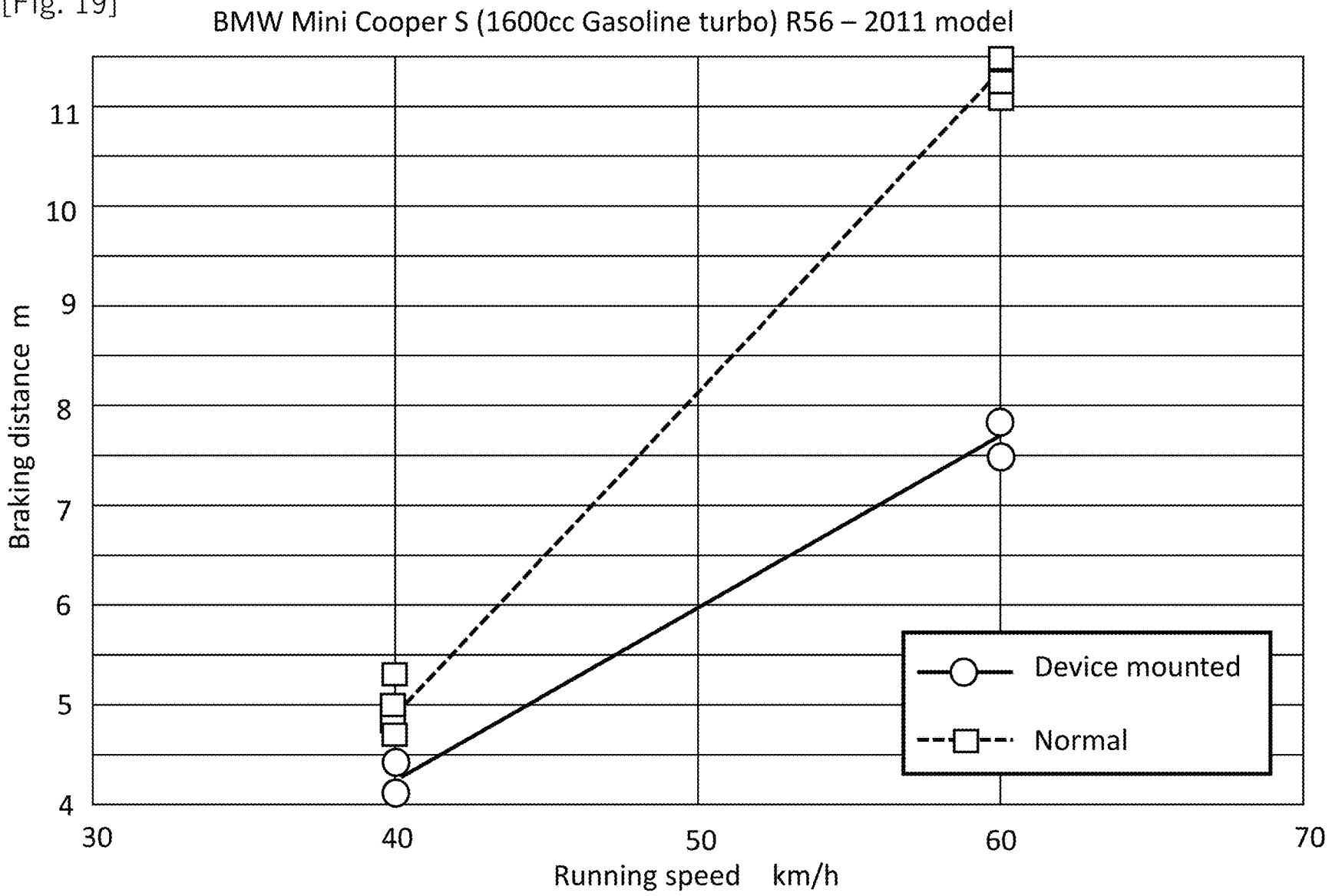

[Fig. 20]
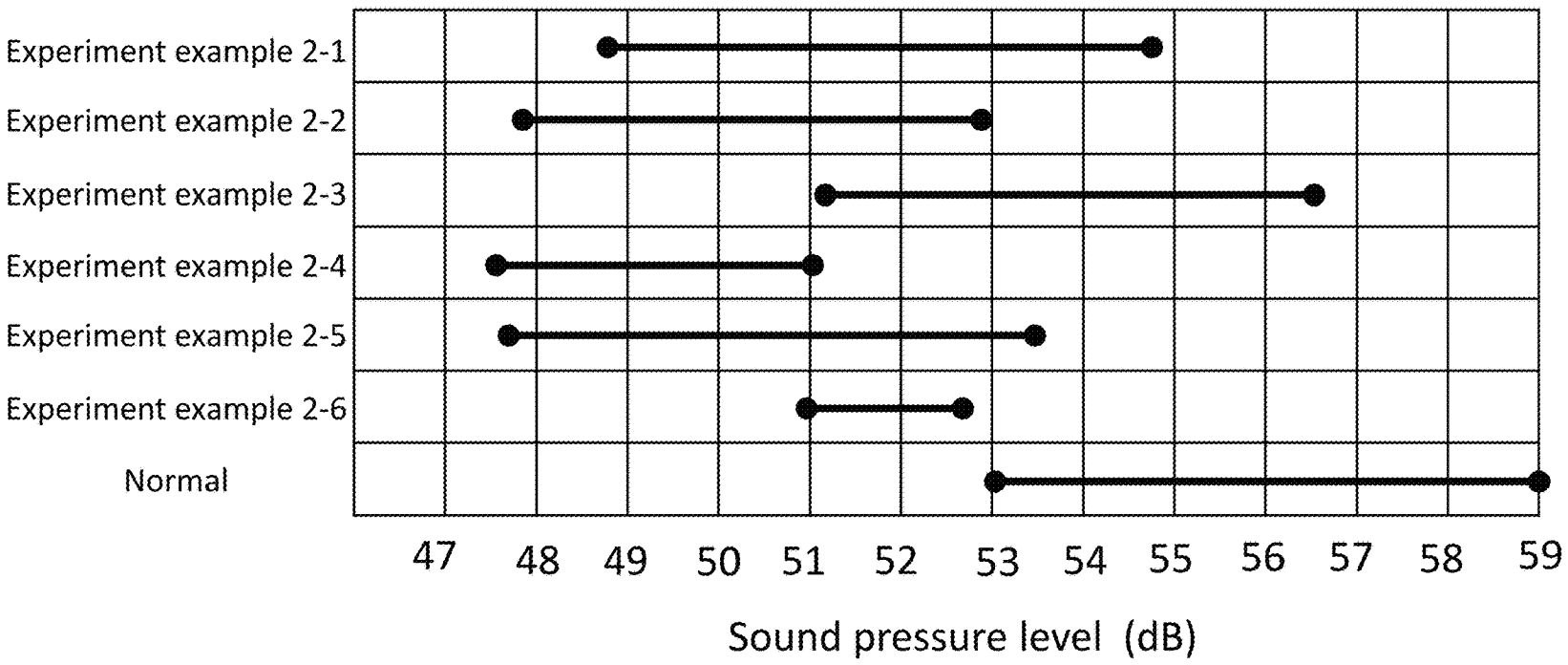

ENERGY CONVERSION EFFICIENCY IMPROVEMENT DEVICE

TECHNICAL FIELD

The present invention relates to an energy conversion efficiency improvement device.

BACKGROUND ART

As one aspect of the energy conversion efficiency improvement device, an ore mixture is known which is set in an internal combustion engine-powered vehicle typified by an automobile for the purpose of improving the fuel efficiency of the vehicle (see PTL 1).

The ore mixture disclosed in PTL 1 is arranged in the center console of a vehicle, or the like, and includes a silicon single crystal powder, a charcoal powder, a rock crystal powder, and a rare metal simple substance powder, or a rare metal compound powder. By arranging the ore mixture in accordance with PTL 1 at a prescribed position of a vehicle, it is possible to reform the liquid such as a gasoline fuel or an oil in a vehicle, and to improve the fuel efficiency. This can sufficiently bring out the performances of the vehicle.

CITATION LIST

Patent Literature

[PTL 1]
Japanese Patent No. 6253115

SUMMARY OF INVENTION

Technical Problem

However, there has been a demand for more enhancing the improvement of the fuel efficiency of a vehicle still more than the fuel efficiency improving effect yielded by the ore mixture disclosed in PTL 1.

The present invention was completed in view of the foregoing problem, and addresses an energy conversion efficiency improvement device capable of further improving the energy conversion efficiency in the installed equipment, or the like.

Solution to Problem

In order to solve the problem, an energy conversion efficiency improvement device in accordance with one aspect of the present invention includes a first antenna including a conducting wire wound therein, both ends of the conducting wire being connected with a direct-current power source, an LC circuit unit connected with the conducting wire of the first antenna, and having at least one LC module including an inductance element and a capacitor element connected in series or in parallel with each other, a joined material portion including at least two different kinds of materials joined with each other, and a horn component including a conductor, formed line-symmetrically with respect to the central axis, and formed in a shape having an external diameter increasing in one direction along the central axis.

Advantageous Effects of Invention

The present invention can implement an energy conversion efficiency improvement device capable of further improving the energy conversion efficiency in the installed equipment, or the like.

BRIEF DESCRIPTION OF DRAWINGS

FIG. 1 is a schematic block view of an energy conversion efficiency improvement device in accordance with Embodiment 1.

FIG. 2 is a view showing a circuit configuration of the outline of a first antenna and a LC circuit unit of the energy conversion efficiency improvement device in accordance with Embodiment 1.

FIG. 3 is a view showing a joined material portion of the energy conversion efficiency improvement device in accordance with Embodiment 1.

FIG. 4 is a cross sectional view showing a horn component of the energy conversion efficiency improvement device in accordance with Embodiment 1.

FIG. 5 is a side view showing one example of a sheet-shaped member of the energy conversion efficiency improvement device in accordance with Embodiment 1.

FIG. 6 is a side view showing another example of the sheet-shaped member of the energy conversion efficiency improvement device in accordance with Embodiment 1.

FIG. 7 is a view showing one example of a first antenna of the energy conversion efficiency improvement device in accordance with Embodiment 1.

FIG. 8 is a view showing another example of the first antenna of the energy conversion efficiency improvement device in accordance with Embodiment 1.

FIG. 9 is a view showing a still other example of the first antenna of the energy conversion efficiency improvement device in accordance with Embodiment 1.

FIG. 10 is a view showing a furthermore example of the first antenna of the energy conversion efficiency improvement device in accordance with Embodiment 1.

FIG. 11 is a view showing a still furthermore example of the first antenna of the energy conversion efficiency improvement device in accordance with Embodiment 1.

FIG. 12 is a view showing one example of a conducting wire constituting the first antenna of the energy conversion efficiency improvement device in accordance with Embodiment 1.

FIG. 13 is a circuit diagram showing one example of a configuration of an LC circuit unit of the energy conversion efficiency improvement device in accordance with Embodiment 1.

FIG. 14 is a schematic block view of an energy conversion efficiency improvement device in accordance with Embodiment 2.

FIG. 15 is a view showing a circuit configuration of the outline of first and second antennas and the LC circuit unit of the energy conversion efficiency improvement device in accordance with Embodiment 2.

FIG. 16 is a schematic block view of an energy conversion efficiency improvement device in accordance with Embodiment 3.

FIG. 17 is a graph showing one example of the experimental data of the fuel efficiency of an automobile including an energy conversion efficiency improvement device in accordance with Experiment Example 1 set therein.

FIG. 18 is a graph showing another example of the experimental data of the fuel efficiency of an automobile including the energy conversion efficiency improvement device in accordance with Experiment Example 1 set therein.

FIG. 19 is a graph showing one example of the experimental data of the braking distance of the automobile including the energy conversion efficiency improvement device in accordance with Experiment Example 1 set therein.

FIG. 20 is a table showing one example of the experimental data of the indoor environmental sound of the automobile including an energy conversion efficiency improvement device in accordance with Experiment Example 2 set therein.

DESCRIPTION OF EMBODIMENTS

Below, embodiments of the present invention will be described with reference to the accompanying drawings. Incidentally, the embodiments described below do not limit the invention in accordance with the scope of the appended claims. Further, all of various elements and combinations thereof described in the embodiments are not necessarily essential for solution to problem of the invention.

Embodiment 1

FIG. 1 is a schematic block view of an energy conversion efficiency improvement device in accordance with Embodiment 1.

The energy conversion efficiency improvement device 1 in accordance with the present embodiment has a first antenna 10, an LC circuit unit 11, a joined material portion 12, a horn component 13, a sheet-shaped member 14, and a second antenna 15. These are arranged vertically in the order of the first antenna 10, the LC circuit unit 11, the joined material portion 12, the horn component 13, the sheet-shaped member 14, and the second antenna 15 as shown in FIG. 1, and are accommodated in a housing 16.

However, from the viewpoint of an energy conversion efficiency improving effect described later, it is not essential that the first antenna 10 and the rest are arrayed and arranged vertically in the order shown in FIG. 1. The experimental results by the applicant proves that the arrangement of the first antenna 10 and the rest in the proximity in around 1 m can provide desirable effects. Further, the order of the arrangement of the first antenna 10 and the rest also has no particular restriction. In addition, it is also not necessary that the first antenna 10 and the rest are accommodated in the housing 16.

FIG. 2 is a view showing a schematic circuit configuration of the outline of the first antenna 10 and the LC circuit unit 11 of the energy conversion efficiency improvement device 1 in accordance with Embodiment 1.

The first antenna 10 is connected with a direct-current power source not shown in the drawing. When the energy conversion efficiency improvement device 1 of the present embodiment is arranged in the interior of an automobile, the direct-current power source is preferably an on-board battery (direct-current 12 V).

Between the first antenna 10 and the direct-current power source, as shown in FIG. 2, a direct-current voltage stabilization/current control circuit 20 is interposed. When the direct-current power source is an on-board battery, the output voltage of the on-board battery may become unstable. Further, the LC circuit unit 11 described later does not require passage of a large current therethrough. Accordingly, the direct-current voltage stabilization/current control circuit 20 is provided from the viewpoint of stabilizing the output voltage of the on-board battery, and further restricting the input current to the LC circuit unit 11 to a prescribed value (as one example, the current value of mA order). The direct-current voltage stabilization/current control circuit 20 itself is a known circuit, and hence a description on a specific circuit configuration thereof is omitted.

The first antenna 10 includes a conducting wire 21 wound therein as shown in FIGS. 1 and 2. Both ends 21*a* and 21*b* of the conducting wire 21 are respectively connected with a direct-current power source via the direct-current voltage stabilization/current control circuit 20. As a result of this, a direct-current power source is supplied to the first antenna 10.

The first antenna 10 may be of a doughnut type including the conducting wire 21 wound in a ring shape as shown in FIG. 7, or may be of a pancake type including the conducting wire 21 wound from the central part toward the outer edge without a large gap as shown in FIG. 8, or further, may be of a Mobius type including the conducting wire 21 wound in a shape of the FIG. 8 or the sign Go in a plan view a plurality of times as shown in FIG. 9. Still alternatively, as shown in FIG. 10, a pancake type is also acceptable which includes the conducting wire 21 wound in such a manner as to extend from the outer edge toward the central part, and further to be folded back from the central part, and to extend to the outer edge again. Then, as shown in FIG. 11, the one having a three-dimensional shape including the combination of the shapes shown in FIGS. 7 to 10 is also acceptable.

The material of the conducting wire 21 constituting the first antenna 10 has no particular restriction. Examples thereof may include an enamel-coated or polyvinyl chloride-coated oxygen-free copper wire. Although the conducting wire 21 shown in FIGS. 7 to 11 is a single line, a plurality of conducting wires 21 may be arranged in parallel with each other to be wound for constituting the first antenna 10. Further alternatively, as shown in (a) of FIG. 12, one conducting wire 21 may be folded back at the central part to be wound for constituting the first antenna 10. In addition, as shown in (b) of FIG. 12, the strand-shaped conducting wire 21 obtained by twisting the one shown in (a) of FIG. 12 may be wound for constituting the first antenna 10.

Returning to FIG. 2, the LC circuit unit 11 is respectively connected with the one end 21*b* of the conducting wire 21 constituting the first antenna 10, and the direct-current voltage stabilization/current control circuit 20. The LC circuit unit 11 has at least any one of an LC module 22*a* including an inductance element L1 such as a coil and a capacitor element C1 such as a condenser connected in series with each other, or an LC module 22*b* including an inductance element L2 such as a coil and a capacitor element C2 such as a condenser connected in parallel with each other. Preferably, the LC modules 22*a* and 22*b* are mounted on a common substrate (not shown) to constitute the LC circuit unit 11.

As the coils of the inductance elements L1 and L2, those of a bobbin type, a toroidal type, and the like are known. However, a coil with any size, shape, and type is applicable. What size, or the like of the coil is adopted may be determined according to the object such as an automobile to which the energy conversion efficiency improvement device 1 is applied. Whether the coil is air-cored or dense-cored may also be similarly appropriately determined according to the object. Also for the conducting wire constituting the coil, as with the conducting wire of the first antenna 10, any of a single line or a plurality of lines are applicable.

Incidentally, in association with the fact that the current supplied to the LC circuit unit 11 is restricted by the direct-current voltage stabilization/current control circuit 20, the inductance value of the inductance element L1 or L2 may only be, for example, 50 mH to 100 mH, or a numerical value equal to or smaller than that.

The condenser of the capacitor element C1 or C2 also does not have no particular restriction on the kind thereof. Further, in association with the fact that the current supplied to the LC circuit unit 11 is restricted by the direct-current voltage stabilization/current control circuit 20, the capacitance value of the capacitor element C1 or C2 may only be, for example, 50 μF to 100 μF, or a numerical value equal to or smaller than that.

The LC circuit unit 11 may have a plurality of LC modules 22*a* and 22*b*. In the example shown in FIG. 2, the LC circuit unit 11 has a plurality of LC modules 22*a* and 22*b*, more particularly, has one LC module 22*a* and one LC module 22*b*. The LC modules 22*a* and 22*b* are connected in parallel with each other for constituting the LC circuit unit 11.

When the LC circuit unit 11 thus has a plurality of LC modules 22*a* and 22*b*, the resonance frequencies of respective LC modules 22*a* and 22*b*

$$f = \frac{1}{2\pi\sqrt{LC}} \quad \text{[Math. 1]}$$

(where L is the inductance value of the inductance element, and C is the capacitance value of the capacitor element) are preferably different.

The number of the LC modules 22*a* and 22*b* constituting the LC circuit unit 11 has no particular restriction. As shown in (a) to (d) of FIG. 13, the plurality of LC modules 22*a* and 22*b* may be connected in series or in parallel with each other for constituting the LC circuit unit 11.

FIG. 3 is a view showing the joined material portion 12 of the energy conversion efficiency improvement device 1 in accordance with Embodiment 1.

As shown in FIG. 3, the joined material portion 12 includes at least two different kinds of materials joined with each other therein. The example shown in FIG. 3 is configured by, to the upper surface and the lower surface in the drawing of the first sheet material 23 including a given substance, bonding second sheet materials 24 each including a different substance from the substance constituting the first sheet material 23, respectively.

Although each material for the first and second sheet materials 23 and 24 constituting the joined material portion 12 is preferably a noble metal, even if the material is a metal of a general transition metal element, similar effects to those by the one including a noble metal simple substance as the material can be organized. Examples thereof may include metals such as aluminum, copper, iron, zinc, titanium, and nickel. Alternatively, alloys of the noble metals and metals (e.g., stainless steel) are also acceptable. The experimental results by the applicant proves that the combination of aluminum with copper, zinc, titanium, or nickel is effective as the first and second sheet materials 23 and 24 in order to improve the combustion characteristics of the internal combustion engine of a vehicle.

Other than noble metals and metals, ore and an organic substance can also be used as the first and second sheet materials 23 and 24. Other than the foregoing examples, examples of the metal and noble metal usable as the first and second sheet materials 23 and 24 may include aluminum oxide, phosphor copper, duralumin, brass, magnesium oxide, tin plate (tin), lead, silver, gold, and platinum. Examples of the ore may include granite, basalt, tourmaline ore, and ceramics. Examples of the organic substance may include polypropylene, plastic, and polyvinyl chloride.

The experimental results by the applicant proves that use of ores such as noble metals and jewels can provide large effects. On the other hand, from the viewpoint of performing industrial production, it is difficult as a matter of practice to adopt rare metals for the materials. Even when rare metals are used, the cost effectiveness is largely reduced. Further, when natural ores are used, the ratios of the constituent substances largely vary according to the place of production. For this reason, it becomes necessary to blend a plurality of lots. This makes it difficult to keep the product performances at a given level. Therefore, from the viewpoint of performing industrial production, it is preferable to select materials which can be stably supplied.

FIG. 4 is a cross sectional view showing a horn component 13 of the energy conversion efficiency improvement device 1 in accordance with Embodiment 1.

As shown in FIG. 4, the horn component 13 is formed line-symmetrically with respect to a central axis C, and is formed in a shape having an external diameter that increases in one direction along the central axis C.

More particularly, as shown in (a) of FIG. 4, the horn component 13 includes a conductor, and is formed in a shape which is a trapezoid in cross section, and is hollow in the inside, and has openings at the upper and lower surfaces, respectively. Namely, the horn component 13 is formed in the shape of a so-called frustum obtained by removing the cone present at the upper part of the cone, and is formed in a shape formed hollow in the inside and having openings at upper and lower surfaces, respectively. The horn component 13 may be formed in the shape of a frustrum of a pyramid with the bottom surface and the upper surface each formed in a polygon, or may be formed in the shape of a frustum of a cone with the bottom surface and the upper surface each formed in a circular shape. From the viewpoint of ease of manufacturing, the horn component 13 is preferably formed in the shape of a frustum of a cone.

Alternatively, as shown in (b) of FIG. 4, the horn component 13 may be formed in the shape of a frustum, and solid.

Alternatively, the horn component 13 is formed with the upper surface and the bottom surface each formed in the shape of a polygon or a circle, and may be formed in the following shape: in the case of a circle, its radius gradually increases, the increasing rate is not constant; alternatively, in the case of a polygon, its sides gradually increases, the increasing rate is not constant.

In addition, the horn component 13 may be formed in the shape of a hemisphere or a spherical segment (a solid in the shape of an arc in cross section).

Further alternatively, the horn component 13 may be in the shape of the frustums, hemispheres, or the like stacked vertically in a multi-stage.

The member forming the horn component 13 is arbitrary, and is preferably aluminum or copper in view of the availability and the processability of the member.

FIG. 5 is a side view showing one example of the sheet-shaped member 14 of the energy conversion efficiency improvement device 1 in accordance with Embodiment 1.

The sheet-shaped member 14 includes an inorganic matter having different particle diameters formed in the shape of a generally flat sheet therein. The particle diameter of the inorganic matter forming the sheet-shaped member 14 preferably has a plurality of particle diameter ranges. Examples of the particle diameter range may include about 2 to 5 mm, about 0.1 mm, and about several tens micrometers.

Examples of the inorganic matter include natural ores mainly including silicon oxide and carbon (such as charcoal). As other inorganic matters than these, mention may be made of a noble metal and jewel such as a rock crystal. From the viewpoint of the availability and the processability, a rock crystal is preferable.

As other inorganic matters than these, as a rare metal, one or more rare metal simple substance powders or one or more rare metal compound powders may be included from the group consisting of vanadium, gallium, germanium, zirconium, niobium, molybdenum, ruthenium, rhodium, palladium, indium, antimony, tellurium, hafnium, tantalum, tungsten, rhenium, and bismuth. Further, as rare earth metals, one or more rare earth metal simple substance powders or one or more rare earth metal compound powders may be included from the group of scandium, praseodymium, and samarium.

Thus, the sheet-shaped member 14 may include a plurality of kinds of inorganic matters.

The inorganic matter grain or powder having different particle diameters are mixed. As shown in (a) and (b) of FIG. 6, at least some voids thereof are filled with a resin for solidification, so that the mixture is formed in the shape of a generally flat sheet, resulting in the formation of the sheet-shaped member 14. Alternatively, at least some voids thereof are filled with clay or the like, followed by a high-temperature treatment, so that the mixture is integrated as ceramics, and is formed in the shape of a generally flat sheet, resulting in the formation of the sheet-shaped member 14.

Incidentally, for the term "the shape of a generally flat sheet" in the sheet-shaped member 14, the sheet thickness has no particular restriction. A so-called thin film-shaped, or film-shaped inorganic matter aggregate is also included in the "sheet-shaped member 14 in the shape of a generally flat sheet" herein mentioned.

Further, the formation method of the sheet-shaped member 14 is also arbitrary. The sheet-shaped member 14 may be formed in the following manner: an inorganic matter grain or powder is mixed, which is placed in a mold for solidification; or a kneaded body including a resin as a binder is formed, which is applied to the inner surface of the housing 16, one surface of the substrate constituting the LC circuit unit 11, or one surface of the joined material portion 12. Further, the following method is also acceptable: a plurality of sheet-shaped members 14 are superposed, and these are formed into an integral sheet-shaped member 14.

The second antenna 15 includes a conducting wire wound therein as with the first antenna 10. The shape of the second antenna 15 may be appropriately selected from those mentioned for the first antenna 10.

The energy conversion efficiency improvement device 1 of the present embodiment has, for example, the effects of further improving the fuel efficiency of the internal combustion engine of the automobile including the energy conversion efficiency improvement device 1 set therein, and further shortening the braking distance. In other words, the energy conversion efficiency improvement device 1 of the present embodiment can further improve the energy conversion efficiency in the vicinity of the energy conversion efficiency improvement device 1. Such effects will be described in details by Experiment Examples described later.

Embodiment 2

FIG. 14 is a schematic block view of an energy conversion efficiency improvement device in accordance with Embodiment 2, where (a) is a front view and (b) is a side view. Further, FIG. 15 is a view showing a schematic circuit configuration of the outline of the first and second antennas and the LC circuit unit of the energy conversion efficiency improvement device in accordance with Embodiment 2. Incidentally, in the following description, the same constituent elements as those of Embodiment 1 are given the same reference numerals and signs, and a description thereon will be simplified.

The energy conversion efficiency improvement device 1 of the present embodiment has a first antenna 10, an LC circuit unit 11, a joined material portion 12, a horn component 13, and a second antenna 15 as with Embodiment 1 described above.

The LC circuit unit 11 and the first antenna 10 are formed on one substrate 30. On the first antenna 10, for example, a cylindrical guide tube 31 made of aluminum is arranged. The horn component 13 is provided in the inside of the guide tube 31.

The LC circuit unit 11 has an LC module **22*b* including inductance elements L1, L2, L3, and the like such as a coil, and capacitor elements C1, C2, C3, and the like such as a condenser connected in parallel with each other as particularly shown in FIG. 15. In the example shown in FIG. 15, a plurality of LC modules 22*b* are provided in the LC circuit unit 11, and the number thereof has no restriction. Further, the constants (the inductance value and the capacitance value) of the inductance element L and the capacitor element C constituting the LC module 22*b* also has no particular restriction. Conversely, the constant is preferably set so that the energy conversion efficiency improvement device 1** of the present embodiment is set in the target device to obtain desirable effects. For example, the inductance value of the inductance element L is selected arbitrarily within the range of 10 μH to 100 μH, and the capacitor element C having a capacitance value resonating with the inductance element L is selected.

In the example shown in FIG. 14, as the inductance element L and the capacitor element C constituting the LC module **22*b*, a toroidal coil and an electrolytic condenser are shown. The toroidal coil L is preferably, as best shown in (b) of FIG. 14, arranged in front and behind across the guide tube 31. Further, the capacitor element C is preferably arranged side by side across the guide tube 31 as shown in (a) of FIG. 14. Further, the substrate 30 and the toroidal coil L and the electrolytic condenser C are preferably sealed by a resin 32**.

Further, in the LC circuit unit 11, to the conducting wire constituting the LC circuit unit 11, a current catalyst 33 including a different material from the material for the conducting wire is inserted. The current catalyst 33 changes the properties of the energy conversion efficiency improvement device 1 according to the material. The current catalyst 33 includes, for example, an alloy including aluminum, magnesium, titanium, or the like, or conductive ceramics. As described above, the properties of the energy conversion efficiency improvement device 1 are changed according to the material for the current catalyst 33. For this reason, a plurality of current catalysts 33 are prepared. Thus, a switch (including a relay element) not shown in the drawing may switch any current catalyst 33 for allowing a current to flow therethrough.

Between the current catalyst 33 and the first antenna 10, a diode array 34 and a fuse 35 are inserted. The diode array 34 includes at least one diode, and the number thereof is determined according to the material for the current catalyst 33. Incidentally, a transistor may be provided in place of the diode array 34. In this case, the base terminal of the transistor is connected with the second antenna 15, and the emitter terminal and the collector terminal are connected with the conducting wire of the LC circuit unit 11.

In the LC circuit unit 11, a general-purpose battery stabilization circuit 36 is connected as a power supply. However, as with Embodiment 1 described above, an on-board battery may be connected with the LC circuit unit 11. In this case, the general-purpose battery stabilization circuit 36 is unnecessary. The on-board battery may be connected directly with the LC circuit unit 11. Alternatively, the direct-current voltage stabilization/current control circuit 20 shown in Embodiment 1 may be interposed.

The general-purpose battery stabilization circuit 36 has a direct-current power source 37, diodes 38*a* and 38*b* connected in parallel with the direct-current power source 37, and a condenser 39 interposed between the diodes 38*a* and 38*b*. The diodes 38*a* and 38*b* are connected in reverse direction with respect to the direct-current power source 37. Therefore, a current scarcely flows through the diodes 38*a* and 38*b* and the condenser 39. However, the experimental results by the present inventor indicate that when a battery constitutes the direct-current power source 37, the reduction of the battery slows down.

Between the general-purpose battery stabilization circuit 36 and the first antenna 10, a current-adjusting resistance 40 is inserted. The current-adjusting resistance 40 has a resistance value of 1 kΩ to 10 kΩ.

Between the general-purpose battery stabilization circuit 36 and the LC module 22*b*, a light emitting diode 41 as a pilot lamp is inserted. For the light emitting diode 41, a forward direction voltage $V_F$ is selected so that the lightness upon lighting may become proper. The experimental results by the present inventor indicate that a lightness enough to allow observation of lighting is preferable.

The second antenna 15 in the present embodiment is integrally formed while being sandwiched between a pair of metal sheets 42 and 43 each formed in a polygon. The metal sheets 42 and 43 change the properties of the energy conversion efficiency improvement device 1 according to the shape and the material thereof. For this reason, the shape and the material are preferably appropriately selected according to the device in which the energy conversion efficiency improvement device 1 is arranged. The metal sheets 42 and 43 are each formed of, for example, aluminum or copper. Also for the shape, a polygon, further, a regular polygon, or the like can be appropriately selected.

One metal sheet 42 is connected between the diodes 45*a* and 45*b* connected each in the forward direction via the inductance element 44 (which may be a capacitor element). The diodes 45*a* and 45*b* are connected with the conducting wire of the LC circuit unit 11, so that the second antenna 15 is electrically connected with the LC circuit unit 11. Further, a capacitor element 46 is connected in parallel with the diodes 45*a* and 45*b*.

The second antenna 15 including a pair of metal sheets 42 and 43 is arranged, as shown in FIG. 14, in an accommodation part 50 provided under the substrate 30. Further, the joined material portion 12 shown in Embodiment 1 is also arranged in the accommodation part 50. Still further, the sheet-shaped member 14 may be arranged in the accommodation part 50.

Therefore, the energy conversion efficiency improvement device 1 of the present embodiment can also produce the same effects as those by the energy conversion efficiency improvement device 1 of Embodiment 1.

Embodiment 3

FIG. 16 is a schematic block view of an energy conversion efficiency improvement device in accordance with Embodiment 3. The energy conversion efficiency improvement device 1 of the present embodiment is provided in a device targeted for the energy conversion efficiency improvement in association with the energy conversion efficiency improvement device 1 of Embodiment 1 and/or Embodiment 2. For example, when the device targeted for the energy conversion efficiency improvement is an automobile, the energy conversion efficiency improvement device 1 of Embodiment 1 and/or Embodiment 2 is provided in an engine room. The energy conversion efficiency improvement device 1 of the present embodiment is provided in a trunk room.

The energy conversion efficiency improvement device 1 of the present embodiment has an upper outer housing 60 configured by sealing the upper end of the cylindrical member, and a lower outer housing 61 configured by similarly sealing the lower end of the cylindrical member. The upper outer housing 60 and the lower outer housing 61 are substantially equal in external diameter and internal diameter. When the energy conversion efficiency improvement device 1 of the present embodiment is actually used, the upper outer housing 60 is arranged on top of the lower outer housing 61. As a result of this, a space capable of accommodating various members therein is formed inside the upper outer housing 60 and the lower outer housing 61. Similarly, a space capable of accommodating various members is also formed under the lower outer housing 61, and the space is sealed by a back lid 62.

The upper outer housing 60 and the lower outer housing 61 are each formed of a plastic or an aluminum alloy. Further, the back lid 62 is formed of a stainless steel.

In the space formed inside the upper outer housing 60 and the lower outer housing 61, a cylindrical inner housing 63 including a plastic or an aluminum alloy is accommodated. In the inner housing 63, at least one of a conic coil 64 in a shape including a pair of coils each wound in a conic shape connected with each other at apexes thereof, or a cylindrical coil 65 including a pair of coils wound in a cylindrical shape vertically connected with each other is accommodated. The winding direction of the conic coil 64 and the cylindrical coil 65 is reversed midway.

The horn components 13 are provided above and under the conic coil 64 or the cylindrical coil 65, respectively. Preferably, the horn component 13 present above the conic coil 64, or the like is in a shape with an external diameter decreasing downwardly, and the horn component 13 preset under the conic coil 64, or the like is in a shape with an external diameter decreasing upwardly.

Further, under the lower outer housing 61, the joined material portion 12, and further, if required, the sheet-shaped member 14 are accommodated.

The energy conversion efficiency improvement device 1 of the present embodiment can further enhance the energy conversion efficiency improving effects correlatively with the energy conversion efficiency improvement device 1 of Embodiment 1 and/or Embodiment 2.

EXPERIMENT EXAMPLE 1

The details of the energy conversion efficiency improvement device 1 disclosed in Embodiment 1 used for Experiment Example 1 are as follows.

First, a doughnut type antenna was used as the first antenna 10. The LC circuit unit 11 uses respective ones of LC modules 22*a* and 22*b* as shown in FIG. 2, and includes these connected in parallel with each other. The first antenna 10 and the LC circuit unit 11 were sealed by a resin.

Two joined material portions 12 were used, and were arranged over and under the horn component 13, respectively. One joined material portion 12 is configured such that a zinc sheet and a titanium sheet are arranged in a lateral direction on the upper surface or the lower surface of an aluminum sheet of a punched metal including a large number of through holes punched therein. The other joined material portion 12 is configured such that a zinc sheet and a nickel sheet are arranged, and joined in a lateral direction on the upper surface or the lower surface of an aluminum sheet of a punched metal including a large number of through holes punched therein.

The horn component 13 is formed in the shape of a frustum of a cone, and is made of aluminum having a shape which is hollow and is opened at the upper surface and the bottom surface.

The sheet-shaped member 14 includes a synthetic resin sheet and a nickel alloy sheet arranged and stacked in the lateral direction on the upper surface or the lower surface of a ceramic sheet including ore particles.

Then, the first antenna 10, LC circuit unit 11, joined material portion 12, horn component 13, and sheet-shaped member 14 are stacked vertically in the order as shown in FIG. 1, and are accommodated in the housing 16 for constituting the energy conversion efficiency improvement device 1 of Experiment Example.

<Fuel Efficiency Test Part 1>

Using a Mini Cooper S (displacement 1600 CC gasoline engine with a turbocharger) R56 saloon (2011 model) manufactured by BMW Co., a fuel efficiency test was performed. The fuel efficiency was measured by the full tank method. Traveling was performed using a plurality of sections different in proportion of the expressway in the travelled distance, and the measurement of the fuel efficiency was performed. The travelled distance was measured by performing the fixed point observation of a specific section by an on-board computer mounted on the automobile (on-board computer) used for the fuel efficiency test. By the fuel efficiencies when the energy conversion efficiency improvement device 1 of Experiment Example is mounted and when not mounted, the fuel efficiency improving effects by the energy conversion efficiency improvement device 1 of Experiment Example were measured. All the fuel efficiency tests were carried out by the same driver.

The results of the fuel efficiency test are shown in the graph of FIG. 17. A solid line is the graph of the fuel efficiency when the energy conversion efficiency improvement device 1 of Experiment Example is mounted, and a broken line is the graph of the fuel efficiency when the energy conversion efficiency improvement device 1 of Experiment Example is not mounted (i.e., in a commercially available state). The fuel efficiency when the energy conversion efficiency improvement device 1 of Experiment Example is mounted surpasses the fuel efficiency when not mounted not depending upon the proportion of the expressway in the measurement section.

Particularly, it is indicated that the fuel efficiency improving effects are enhanced with an increase in proportion of the expressway. This is presumed due to the fact that the energy conversion efficiency improvement device 1 of Experiment Example is particularly high in fuel efficiency improving effects in the region where the gasoline engine is rotated constantly.

<Fuel Efficiency Test Part 2>

The foregoing fuel efficiency test was also performed for a 118d M Sport (displacement 2000 CC diesel engine with a turbocharger) F20 (2019 model) manufactured by BMW Co. The results of the fuel efficiency test are shown in the graph of FIG. 18. The results of the same trend as that of the fuel efficiency test Part 1 were obtained. However, the fuel efficiency improving effects tended to be lower than those of the fuel efficiency test Part 1. This is presumed due to the following: with the gasoline engine, the fuel is ignited using sparks in the inside for causing combustion; in contrast, with the diesel engine, a liquid fuel is injected in the inside for performing compression ignition, resulting in a higher compression ratio; accordingly, the combustion efficiency is high in the first place.

<Breaking Test>

Using a Mini Cooper S (displacement 1600 cc gasoline engine with a turbocharger) R56 saloon (2011 model) manufactured by BMW Co., a breaking test for measuring the braking distance upon breaking suddenly an automobile running at a constant speed was performed. All the breaking tests were carried out by the same driver.

The results of the breaking test are shown in the graph of FIG. 19. The solid line is the graph of the braking distance when the energy conversion efficiency improvement device 1 of Experiment Example is mounted, and the broken line is the graph of the braking distance when the energy conversion efficiency improvement device 1 of Experiment Example is not mounted (i.e., in the commercially available state). It is indicated that the braking distance improving effects are enhanced with an increase (fastness) in speed before sudden braking.

Thus, the energy conversion efficiency improvement device 1 of Experiment Example 1 can provide both the fuel efficiency improving effects and the braking distance improving effects.

EXPERIMENT EXAMPLE 2

The changes in indoor environmental sound upon arranging the energy conversion efficiency improvement device 1 of Embodiment 2 in the radiator of an automobile, and arranging the energy conversion efficiency improvement device 1 of Embodiment 3 in the trunk room of the same automobile were measured. For the energy conversion efficiency improvement device 1 of Embodiment 2, 6 kinds thereof were prepared by changing the shapes and the materials of the metal sheets 42 and 43, and the orientation of the horn component 13.

The used automobile is the 118d M Sport (displacement 2000 CC diesel engine with a turbocharger) F20 (2019 model) manufactured by BMW Co., which is equal to that of Experiment Example 1 described above. The acoustic pressure of the indoor environmental sound was measured with the air conditioner included in the automobile not working, and with a noise not occurring therearound as the interior environment. The measurement place is the inventor's home parking lot. The indoor environmental sound was measured by a digital sound level meter TA8151 by TASI Co. The measurement was performed at a position 10 cm over the armrest of the automobile front seat on hand. The measurement time was 10 seconds. This was repeated at intervals of 30 seconds three times to determine the maximum value and the minimum value.

As shown in the table of FIG. 20, when the energy conversion efficiency improvement devices 1 of Embodiment 2 and Embodiment 3 were not set, the indoor environmental sound was 53 dB to 59 dB. Whereas, when the energy conversion efficiency improvement devices 1 of Embodiment 2 and Embodiment 3 were set, the indoor environmental sound was reduced to a minimum of 47.9 dB, and a maximum of 56.6 dB. The reduction of the indoor environmental sound can be construed as the result of the improvement of the energy conversion efficiency mainly at the noise occurrence source such as the engine of the automobile (such as the reduction of the friction of the engine).

Incidentally, the present invention is not limited to the foregoing Embodiments, and includes various modified examples. For example, the foregoing description of Embodiments is a detailed description of the present invention for easy explanation, and are not necessarily limited to those including all the configurations described. Further, some of the configuration of a given Embodiment can be replaced with the configuration of another Embodiment. Alternatively, it is also possible to add the configuration of other Embodiments to the configuration of a given Embodiment. Further, it is possible to add/delete/replace other configurations to/from/with some of the configurations of respective Embodiments.

Further, as the control wire and the information wire, those considered necessary for description are shown. All the control wires and information wires are not always shown for a product. Actually, it may be considered that almost all the configurations are connected with one another.

REFERENCE SIGNS LIST

1 Energy conversion efficiency improvement device
10 First antenna
11 LC circuit unit
12 Joined material portion
13 Horn component
14 Sheet-shaped member
15 Second antenna
16 Housing
20 Current control circuit
21 Conducting wire
22*a*, 22*b* LC module
30 Substrate
31 Guide tube
33 Current catalyst
34 Diode array
36 General-purpose battery stabilization circuit
42, 43 Metal sheet
50 Accommodation part
60 Upper outer housing
61 Lower outer housing
63 Inner housing
64 Conic coil
65 Cylindrical coil

The invention claimed is:

1. An energy conversion efficiency improvement device comprising:

a first antenna including a conducting wire wound therein, the conducting wire being connected to a direct-current power source;

an LC circuit unit connected with the conducting wire of the first antenna, and having at least one LC module including an inductance element and a capacitor element connected in series or in parallel with each other;

a joined material portion including at least two different kinds of materials joined with each other; and a horn component including a conductor, formed line-symmetrically with respect to a central axis, and formed in a shape having an external diameter increasing in one direction along the central axis.

2. The energy conversion efficiency improvement device according to claim 1, comprising a stabilization circuit interposed between the direct-current power source and the first antenna, and stabilizing a direct-current voltage from the direct-current power source, and limiting a direct current from the direct-current power source to a prescribed value.

3. The energy conversion efficiency improvement device according to claim 1, comprising a second antenna including a conducting wire wound therein.

4. The energy conversion efficiency improvement device according to claim 1, comprising a sheet-shaped member including an inorganic matter having different particle diameters formed in a generally flat sheet shape.

5. The energy conversion efficiency improvement device according to claim 4, wherein the sheet-shaped member is provided at the LC circuit unit and/or the joined material portion.

6. The energy conversion efficiency improvement device according to claim 4, comprising a housing accommodating at least the first antenna, the LC circuit unit, the joined material portion, and the horn component, wherein the sheet-shaped member is provided at an inner surface of the housing.

7. The energy conversion efficiency improvement device according to claim 1, the first antenna, the LC circuit unit, the joined material portion, and the horn portion being arrayed in line.

8. The energy conversion efficiency improvement device according to claim 3, the first antenna, the LC circuit unit, the joined material portion, the horn portion, and the second antenna being arrayed in line.

9. The energy conversion efficiency improvement device according to claim 4, the first antenna, the LC circuit unit, the joined material portion, the horn portion, and the sheet-shaped member being arrayed in line.

10. The energy conversion efficiency improvement device according to claim 3, comprising a sheet-shaped member including an inorganic matter having different particle diameters formed in a generally flat sheet shape, the first antenna, the LC circuit unit, the joined material portion, the horn portion, the second antenna, and the sheet-shaped member being arrayed in line.

11. The energy conversion efficiency improvement device according to claim 1, the first antenna, the LC circuit unit, the joined material portion, and the horn portion being arrayed in line.

12. The energy conversion efficiency improvement device according to claim 3, the first antenna, the LC circuit unit, the joined material portion, the horn portion, and the second antenna being arranged at a proximity of 1 meter or less.

13. The energy conversion efficiency improvement device according to claim 4, the first antenna, the LC circuit unit, the joined material portion, the horn portion, and the sheet-shaped member being arranged at a proximity of 1 meter or less.

14. The energy conversion efficiency improvement device according to claim 3, comprising a sheet-shaped member including an inorganic matter having different particle diameters formed in a generally flat sheet shape, the first antenna, the LC circuit unit, the joined material portion, the horn portion, the second antenna, and the sheet-shaped member being arranged at a proximity of 1 meter or less.

15. The energy conversion efficiency improvement device according to claim 1, comprising a housing accommodating at least the first antenna, the LC circuit unit, the joined material portion, and the horn component, the housing being capable to be arranged in an engine room of an automobile.

16. The energy conversion efficiency improvement device according to claim 1, comprising an accompanying device being used in combination with the energy conversion efficiency improvement device, the accompanying device comprising:

a wound coil; and a second horn component with an external diameter increasing in one direction provided over or under the coil.

17. The energy conversion efficiency improvement device according to claim 16, comprising a second housing accommodating the coil and the second horn component, the second housing being capable to be arranged in a trunk of an automobile.

18. An accompanying device being used in combination with an energy conversion efficiency improvement device, the energy conversion efficiency improvement device comprising:

a first antenna including a conducting wire wound therein, the conducting wire being connected to a direct-current power source;

an LC circuit unit connected with the conducting wire of the first antenna, and having at least one LC module including an inductance element and a capacitor element connected in series or in parallel with each other;

a joined material portion including at least two different kinds of materials joined with each other; and a horn component including a conductor, formed line-symmetrically with respect to a central axis, and formed in a shape having an external diameter increasing in one direction along the central axis, the accompanying device comprising:

a wound coil; and a second horn component with an external diameter increasing in one direction provided over or under the coil.

19. The accompanying device according to claim 18, the energy conversion efficiency improvement device being capable to be arranged in an engine room of an automobile, and the accompanying device being capable to be arranged in a trunk room of the automobile.

* * * * *